United States Patent [19]

Bühler et al.

[11] 3,983,588

[45] Oct. 5, 1976

[54] PROCESS FOR THE DYEING OR PRINTING AND SIMULTANEOUS FINISHING OF CELLULOSE MATERIALS

[75] Inventors: Hermann Bühler, Reinach; Arthur Buhler, Rheinfelden; Hans Ackermann, Bottmingen, all of Switzerland

[73] Assignee: Ciba-Geigy AG, Basel, Switzerland

[22] Filed: Feb. 20, 1974

[21] Appl. No.: 444,548

Related U.S. Application Data

[63] Continuation of Ser. No. 210,138, Dec. 20, 1971, abandoned.

[30] Foreign Application Priority Data

Dec. 23, 1970 Switzerland ..... 19067/70
Oct. 4, 1971 Switzerland ..... 14460/71

[52] U.S. Cl. ..... 8/17; 8/18 R; 8/40; 8/54.2; 260/29.2 N; 260/29.2 TN; 260/29.2 EP; 260/29.2 UA

[51] Int. Cl.[2] ..... D06P 1/20; D06P 3/60; D06P 5/02; D06P 7/00

[58] Field of Search ..... 8/17, 18, 54.2, 40

[56] References Cited

UNITED STATES PATENTS

| | | | |
|---|---|---|---|
| 2,197,357 | 4/1940 | Widmer et al. | 260/17.3 |
| 3,044,843 | 7/1962 | Tullio | 8/17 |
| 3,046,075 | 7/1962 | Kantner et al. | 8/18 |
| 3,053,849 | 9/1962 | Clark et al. | 8/62 |
| 3,074,945 | 1/1963 | Staeuble et al. | 8/54.2 |
| 3,108,105 | 10/1963 | Staeuble | 8/40 |
| 3,198,595 | 8/1965 | Mawson et al. | 8/18 |
| 3,265,461 | 8/1966 | Luetzel et al. | 8/54.2 |
| 3,285,770 | 11/1966 | Hegemann et al. | 8/54.2 |
| 3,501,259 | 3/1970 | Long | 8/54.2 |
| 3,679,348 | 7/1972 | Asahi et al. | 8/18 |

FOREIGN PATENTS OR APPLICATIONS

| | | | |
|---|---|---|---|
| 257,087 | 5/1963 | Australia | 8/18 |
| 415,911 | 1/1967 | Switzerland | 8/54.2 |
| 794,179 | 4/1958 | United Kingdom | 8/54.2 |
| 846,505 | 8/1960 | United Kingdom | 8/54.2 |
| 916,699 | 1/1963 | United Kingdom | 8/18 |

*Primary Examiner*—Ronald W. Griffin
*Attorney, Agent, or Firm*—Wenderoth, Lind & Ponack

[57] ABSTRACT

A process for the dyeing or printing and simultaneous finishing of cellulose materials is disclosed the said process comprises impregnating these materials with an aqueous liquor containing a specific dyestuff which contains at least one bis-hydroxy-alkylamino group bound to a pyrimidine or triazine nucleus and bridged via an amino group to the dyestuff molecule, synthetic resin forming intermediate or aminoplast, an acid catalyst and optionally further additives, thereupon drying the thus impregnated material or steaming or storing at room temperature and finally subjecting it to a treatment at elevated temperature and optionally washing.

The dyeings thus obtained have especially very high fixing yields of the dyestuffs and are moreover fast to light and to washing and have further finishing effects such as, e.g. improvement of the handle and resistance to shrinkage.

31 Claims, No Drawings

PROCESS FOR THE DYEING OR PRINTING AND SIMULTANEOUS FINISHING OF CELLULOSE MATERIALS

This is a continuation of application Ser. No. 210,138, filed Dec. 20, 1971, now abandoned.

The present invention relates to a process for the dyeing or printing and simultaneous finishing of cellulose materials, to the preparations used therefor, as well as to the material dyed or printed according to said process.

Processes are known from the British Pat. No. 906,140 and from the Swiss Pat. No. 415,911 for the dyeing and simultaneous finishing of textile materials with the aid of dyestuffs containing at least one polyhydroxyalkyl group, or with metal-containing phthalocyanine dyestuffs which contain, amongst other things, at least one bis-(dihydroxy-alkylamino)-triazinylamino group, in the presence of a resin-forming intermediate product and of a catalyst releasing an acid. These known processes have not become of any practical importance, since the dyestuff and fixing yields are too low.

A process has now been found which renders possible with especially azo and anthraquinone dyestuffs the dyeing in deep shades and simultaneous finishing of cellulose materials.

This process is characterised in that cellulosic material is impregnated with an aqueous liquor containing:

a. at least one dyestuff of the formula I

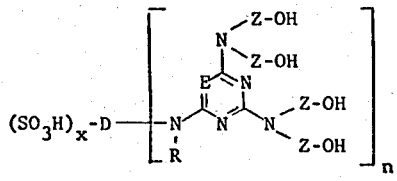

(I)

wherein

D represents the radical of an azo or anthraquinone dyestuff, x represents the numbers 1 to 4, R represents hydrogen or a lower alkyl group, E represents

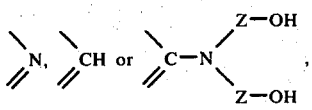

Z each independently represents an alkylene radical having 2 to 5 carbon atoms, and n represents the number 1 or 2; or at least one dyestuff of the formula II $$(W)_{m-1} - D' - [A - X]_n \qquad \text{(II)}$$

wherein

W represents an $SO_3H$ or a COOH group,

D′ represents a chromophorous radical of a formazan dyestuff, an azomethine or nitro dyestuff and preferably of an azo, anthraquinone and phthalocyanine dyestuff, A represents a bridge member, X represents a hydroxyalkyl radical or a cycloalkyl radical having at least one hydroxyl group, and m and n′ represent whole numbers to the value of 1 to 4, b. an intermediate product forming synthetic resin or an aminoplast which is soluble or at least dispersible in water, c. an acid catalyst, and d. optionally further additives, the thus impregnated cellulosic material being then, after squeezing out, subsequently dried, steamed, or stored at room temperature and thereupon subjected to a treatment at elevated temperature, and, finally, optionally washed.

Where a printing paste is used, it can contain as further additives the usual thickeners such as starch and starch ether, tragacanth or methyl cellulose, particularly however alginates such as sodium alginate.

As radical of an azo dyestuff, D represents in formula I, e.g. the radical of a metal-free or metal-containing monoazo-, disazo or polyazo dyestuff, including a formazan dyestuff.

The azo and anthraquinone dyestuffs of formula I usable according to the invention are obtained in a manner known per se, e.g. by reaction of the corresponding di- or trihalogen-, advantageously -chlorotriazine or -pyrimidine-azo or -anthraquinone dyestuffs with dihydroxyalkylamines, especially diethanolamine.

Further dyestuffs suitable for carrying out the process correspond preferably to the formula IIa $$(W)_{m-1} - D' - [A_1 - X_1]_n \qquad \text{(IIa)}$$

wherein W, D′, m and n′ have the meaning given above, $X_1$ is a hydroxyalkyl radical having 1 to 10 carbon atoms or a cyclohexyl radical having at least one hydroxyl group, and $A_1$ represents a heterocyclic-aromatic radical, a substituted amino, carbonamido, sulphonamido radical or an alkyleneaminocarbonyl radical, or an $-SO_2-$ and an —NHCO-group.

Particularly suitable are moreover the dyestuffs of the formula IIb $$(W)_{m-1} - D' - [A_2 - X_1]_n \qquad \text{(IIb)}$$

wherein W, D′, $X_1$, m and n′ have the meaning given above and $A_2$ corresponds to the groups $-NX_1-$, $-SO_2NX_1-$, $-CONX_1-$, $-(CH_2)_pNHCOX_1-$, or to the formulae

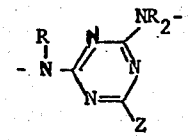

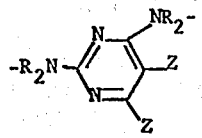

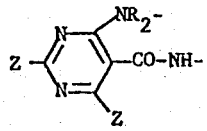

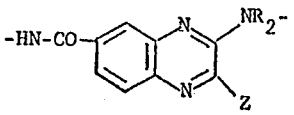

or

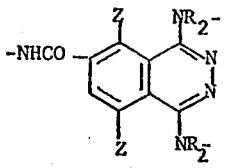

wherein $X_1$ has the meaning given under formula IIa

P represents 1 or 2,

R represents a hydrogen atom, or an alkyl group having 1 to 4 carbon atoms, $R_2$ represents a hydrogen atom, an alkyl group having 1 to 4 carbon atoms, a hydroxyalkyl group having 1 to 6 carbon atoms, or a cycloalkyl radical having at least one hydroxyl group, and Z represents a hydrogen or a halogen atom, an alkyl, aryl, alkoxy, aryloxy, alkylmercapto, arylmercapto group, an unsubstituted or substituted amino group, or a hydroxyl or thiocyanato group.

As a chromophorous radical of an azo dyestuff, D′ represents also here, e.g. the radical of a metal-free or metal-containing monoazo, disazo or polyazo dyestuff.

Of the anthraquinones of formula II, the 1,4-diaminoanthraquinones are mentioned, e.g. such ones which are further substituted on at least one amino group.

In the case of the phthalocyanine dyestuffs of formula II, these are complex compounds with heavy metals such as manganese, cobalt and nickel, preferably, however, copper. The phthalocyanine dyestuffs contain as acid water-solubilising groups preferably carboxylic acid groups, sulphonic acid groups or sulphonic acid amide groups, whereby 1 to 4 such groups, or optionally more, can be present in the dyestuff molecule.

The substituents $R_2$ in the bridge member $A_2$ of formula IIb stand for a hydrogen atom, or a lower alkyl group such as methyl, ethyl, propyl and butyl, which, for their part, can be again substituted, e.g. with one or more hydroxyl, methoxy or ethoxy groups. Furthermore, $R_2$ can be a cycloalkyl radical having at least one hydroxyl group, such as, e.g. mono- or dihydroxycyclohexyl.

Examples in the case of the substituents Z can be: lower alkyl groups such as methyl and ethyl; halogen atoms such as chlorine and bromine; monocyclic aryl groups such as phenyl and tolyl; alkoxy groups such as methoxy and ethoxy; aryloxy groups such as the monocyclic aryloxy groups such as phenoxy and sulphophenoxy; lower alkylmercapto groups such as methyl- and ethylmercapto; arylmercapto groups such as phenyl- or tolylmercapto; substituted amino groups such as mono- and disubstituted alkylamino groups having 1 to 4 carbon atoms per alkyl radical, hydroxyalkylamino groups such as hydroxyethylamino and dihydroxyethylamino; also phenylamino, sulphophenylamino, disulphophenylamino, naphthylamino, sulphonaphthylamino, disulphonaphthylamino, benzylamino and cyclohexylamino.

The dyestuffs of formula I as well as of Formula II are used in amounts depending on the desired depth of colour of the material, generally in amounts of about 10 to 100 g/l of dye liquor, and particularly in amounts of between 40 and 80 g/l of dye liquor.

The synthetic resin-forming intermediates are known from the literature, or are in use in the dyeing industry for the crease-proof finishing of textiles, or for the finishing process to modify the feel of textiles. Mentioned as examples are: epoxides, polyisocyanates, condensates from formaldehyde with phenols or cresols, or with acrolein, as well as mixtures containing the methylol derivatives or lower alkyl ethers of methylol derivatives of monomeric or polymeric compounds, which, for their part, contain several amino- or monosubstituted amino groups, the stated compounds being known, or in use in the trade for the formation of resins by condensation with formaldehyde. Suitable compounds are, for example, monomeric nitrogen compounds such as urea, thiourea, substituted ureas such as alkyl or aryl ureas, and thioureas such as alkylureas or diureas such as dihydroxyethylene urea, ethylene urea, propylene urea, oxypropylene urea and acetylene urea, dicyanodiamide, dicyanodiamidine, diguanides, amides and heterocyclic compounds such as urons, ureids, melamines, triazones such as N-ethyltriazone, and hydantoins, or mixtures of such compounds and polymeric nitrogen compounds such as the polymeric amides produced by reaction of dibasic acids with diamines. The lower alkyl ethers of the methylol derivatives of these compounds are, e.g. the methyl, ethyl, propyl and butyl ethers. Particularly suitable for the increasing of the resistance to creasing of textiles are tetramethylolacetylene urea, melamine/formaldehyde resin and, in particular, N,N′-dimethyloldihydroxyethylene urea.

Furthermore, there can be used aminoplasts, which are dispersible in water, optionally with the aid of a dispersing agent, or preferably aminoplasts soluble in water, in which case the water-solubility need not necessarily be unlimited, so that also such aminoplasts are suitable which produce only in specific proportions a homogeneous solution with water.

Any desired aminoplasts may moreover be employed, and addition products of formaldehyde with methylolatable nitrogen compounds are particularly suitable. These can be mononuclear, or already more highly condensed. Mentioned as methylolatable nitrogen compounds are: 1,3,5-aminotriazines such as N-substituted melamines, e.g. N-butylmelamine, N-trihalomethylmelamines, oxydiaminotriazines, dioxyaminotriazines, triazones, guanamines, e.g. benzoguanimines, acetoguanimines, or also diguanimines; guanylurea, acetylenediurea, or especially 4,5-dihydroxyimidazolidinone-2 and derivatives thereof, e.g. 4,5-dihydroxyimidazolidine-2 substituted in 4-position on the hydroxyl group with the radical $—CH_2CH_2CO—NH—CH_2OH$. It is preferable to use the methylol compounds of urea, of ethylene-urea, of dicyanodiamide or of melamine. Products as highly methylolated as possible produce, in general, particularly valuable products.

Also the ethers of these aminoplast-precondensates can be used together with the reaction products. Those advantageous are, e.g. the ethers of alcohols such as methanol, ethanol, n-propanol, isopropanol, n-butanol, or of pentanols.

Reaction products of methylolatable nitrogen compounds, formaldehyde and polyalkylenepolyamines likewise are of interest. Mixtures of various aminoplasts can also be used.

These synthetic resin-forming intermediates are advantageously used in the form of their aqueous solutions, and in amounts of about 50 to 300 g/l of dye liquor.

The amount of aminoplast is generally not to be lower than that of the dyestuff, and it is recommended, as a rule, that the quantity ratio be so selected that the amount of aminoplast is several times that of the dyestuff. The aqueous preparations advantageously contain, therefore, 3 to 30 per cent by weight of aminoplast, preferably 5 to 20 per cent by weight.

Examples of suitable acid catalysts usable according to the invention are the salts formed from weak bases and mineral acids, such as, e.g. zinc chloride, zinc nitrate, ammonium salts such as ammonium sulphate, ammonium chloride, ammonium dihydrogen phosphate, mineral acid salts of organic amines such as ethanolamine hydrochloride, weak acids, e.g. organic acids such as oxalic acid, and neutral substances which develop acidity on being heated or treated with steam, and as magnesium chloride and ammonium thiocyanate. The acid catalysts are advantageously used in amounts of about 0.1 to 5 per cent preferably 0.5 to 2 per cent per liter of the dye liquor.

The aqueous dye liquor can contain further additives common in the dyeing trade, e.g. agents improving the "handle" such as polyhydroxy compounds, e.g. polyvinyl alcohols, polyvinyl acetate, cellulose ethers, starch and starch ethers, protein-like substances such as casein and gelatine; softening agents such as those commonly used in textile finishing, e.g. silicone compounds, as well as agents repelling dirt, water and oil, such as methacrylic acid resins or sarcosite polyphosphates, or the usual fluorine compounds, as well as flameproofing agents, and wetting and dispersing agents such as e.g. ethylene oxide reaction products with fatty acids, fatty amines or fatty alcohols.

The aqueous liquor can be applied in any known manner to the cellulose material. For example, it can be applied locally by the printing of the material using the aqueous liquor in the form of a printing paste; or it can be applied to the whole surface of the material, e.g. by impregnation, advantageously at temperatures of between 20° and 50° C, and subsequent squeezing to obtain a liquor take-up of about 60 to 80 per cent.

The process is particularly suitable for the continuous method of operating, e.g. for the printing of fabrics under roller pressure or for the impregnating process on the padding machine.

Impregnation is carried out advantageously in a single stage with an aqueous dye liquor containing simultaneously the dyestuff, the synthetic resin-forming intermediate, or the aminoplast, the acid catalyst and, optionally, further additives. Impregnation may, however, also be performed in two stages by firstly treating the cellulose material with an aqueous dye liquor containing only the dyestuff; the material is afterwards squeezed out to give a liquor take-up of about 60 to 80 per cent; the thus pretreated dyed cellulose material, optionally after being dried, is then impregnated with an aqueous liquor containing the synthetic resin-forming intermediate or the aminoplast, the acid catalyst and, optionally, further additives; and subsequently again squeezed out to about 60 to 80 per cent.

The thus impregnated cellulose material is then dried, e.g. for 1 to 15 minutes at a temperature of between 50° and 100° C or steamed after optionally an intermediate drying. As a rule, the wet material is transferred to the steam room where it is steamed with saturated steam at atmospheric pressure for 3 to 30 minutes, or with saturated steam at higher temperature, in which case the time can be correspondingly shortened.

A further possibility, preferably for regenerated cellulosic material, especially staple fibre, consists in that the impregnated material is stored at room temperature for e.g. 8 to 48 hours, especially 24 hours. As well after the steaming process as after the storage process the material can optionally be dried for e.g. 1 to 15 minutes at a temperature of between 50° and 100° C.

The cellulosic material is then subsequently subjected direct to a heat treatment at temperatures of 100° to 220° C, preferably 140° to 180° C. This hardening process, which, depending on the nature of the generation of heat and on the temperature range, can take 30 seconds to 30 minutes, serves particularly to effect the fixation of dyestuff and aminoplast or synthetic resin-forming intermediate on the fibre.

After the hardening process, the dyed or printed and finished cellulosic material can be washed in the usual manner to remove unfixed dyestuff and/or aminoplast or synthetic resin-forming intermediate. The materials are treated for this purpose, e.g. at 40° to 80° C in a solution containing soap or a synthetic detergent, e.g. an ethylene oxide addition product of an alkylphenol, or the sodium salt of 2-heptadecy-N-benzylbenzimidazoledisulphonic acid. In most cases, however, it is not necessary to subject the dyed or printed cellulose material to a subsequent washing treatment.

In the process of the invention it is important that in view of the British specification 906,140 as stated hereinbefore, for the process wherein after the impregnation the cellulosic material is dried only such dyestuffs can be used which correspond to formula I, while for the process of the invention wherein after the impregnation of the cellulosic material said material is steamed or stored at room temperature as well the dyestuffs of formula I as such of formula II can be used.

Suitable cellulosic material according to the invention is, in particular, that made from natural or regenerated cellulose. Examples mentioned are: cotton, hemp, linen, jute, as well as viscose and cellulose acetate fibres, and staple fibres. The fibre material can be in any desired processed condition, and can be obtained, for example, as loose material, fibres, yarn, fabric or knitwear.

The cellulose materials treated by the present process are evenly dyed or printed, with very good dyestuff yields, and have fastness to light and to washing; they moreover display, depending on the type and amount of the applied aminoplasts or synthetic resin-forming intermediates and other additives, further finishing effects such as, e.g. improvement of the handle, of the resistance to shrinkage and to dry and to wet creasing, and of the water-repellent properties.

To be particularly emphasised is the high fixing yield of the dyestuffs.

The following examples further illustrate the invention, without this being limited to the given examples. Where not otherwise stated, the term 'parts' denotes parts by weight, and percentages are given as per cent by weight.

EXAMPLE 1

Cotton fabric is impregnated at a temperature of 20° to 25° C with an aqueous dye liquor containing per 1000 ml 50 g of the dyestuff of the formula:

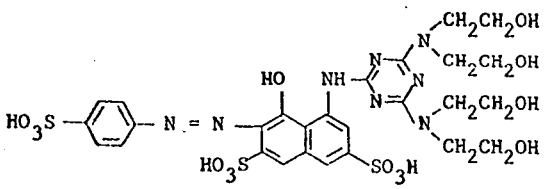

200 g of a 50 percent aqueous solution of N,N'-dimethyloldihydroxyethylene urea, and 20 g of zinc nitrate; the impregnated cotton fabric is subsequently squeezed out to a liquor content of ca. 70 percent relative to the dry weight of the material, dried for 4 minutes at 80° C, and then heated for 4 minutes at 150° C. The material is afterwards rinsed and dried.

Thus obtained is a deeply coloured bluish-red cotton dyeing having a crease-proof finish and fastness to light and to washing (dyestuff yield 96 percent).

If, instead of 200 g of the 50 percent aqueous solution of N,N'-dimethyloldihydroxyethylene urea, 250 g of a 50 percent aqueous solution of one of the synthetic-resin-forming intermediates listed in the following Table I are used, and instead of 20 g of zinc nitrate, the catalysts given in the following Table II are added in the stated amounts, with otherwise the same procedure as described in the example, then similarly deeply coloured and well finished bluish-red cotton dyeings are obtained.

Table I

| Synthetic-resin-forming intermediates |
|---|
| N,N-dimethylolpropylene urea |
| N,N-dimethylolhydroxypropylene urea |
| tetramethylolacetylene urea |
| dimethylol-N-ethyltriazone |

Table II

| Catalysts |
|---|
| 12 g/l of amonium chloride |
| 15 g/l of magnesium chloride |
| 10 g/l of ammonium thiocyanate |
| 12 g/l of ammonium dihydrogen phosphate |
| 15 g/l of ethanolamine hydrochloride |

EXAMPLE 2

Cotton fabric is impregnated at a temperature of 20° to 25° C with an aqueous dye liquor containing per 1000 ml 50 g of the dyestuff of the formula:

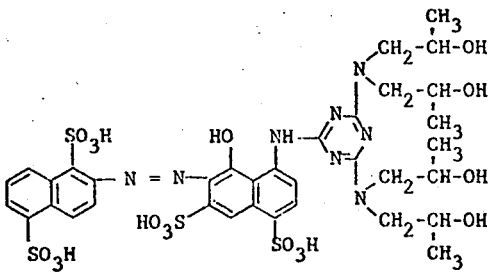

it is then squeezed out to obtain a liquor content of ca. 60 percent relative to the dry weight of the material; the material is afterwards impregnated a second time with an aqueous liquor containing per 1000 ml 250 g of a 50 percent aqueous solution of a melamine/formaldehyde resin and 20 g of magnesium chloride; it is then squeezed out to 75% liquor content, dried for 3 minutes at 90° C, and thereupon heated to 160°C for 3 minutes. The treated cotton fabric is subsequently rinsed, soaped at the boil for 20 minutes, and again rinsed and dried.

In this manner is obtained an intensely red cotton dyeing having a crease-proof finish and fastness to light and to washing (dyestuff yield practically quantitative).

EXAMPLE 3

Cotton fabric is impregnated at a temperature of 25° to 30° C with an aqueous dye liquor containing per 1000 ml 40 g of the dyestuff of the formula:

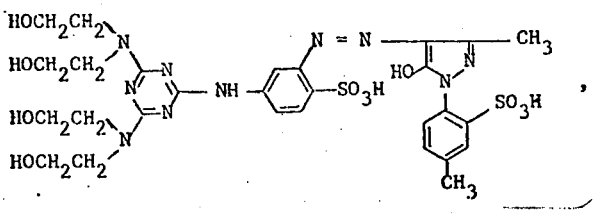

180 g of a 50 percent aqueous solution of N,N'-dimethyloldihydroxyethylene urea and 18 g of magnesium chloride; the material is subsequently squeezed out to a liquor content of ca. 60 percent, dried for 6 minutes at 70° C, and then heated at 140° C for 5 minutes. The cotton fabric is thereupon rinsed and dried.

An intensely yellow cotton dyeing is obtained (dyestuff yield 94 percent).

If, instead of the 180 g of a 50 percent aqueous solution of N,N'-dimethyloldihydroxyethylene urea, 250 g of a 50percent aqueous solution of a urea/formaldehyde resin are used, with heating not to 140° C for 5 minutes but to 210° C for 30 seconds, the procedure being otherwise the same as that described in the example, then a similarly deeply coloured and well finished yellow cotton dyeing is obtained.

EXAMPLE 4

Cotton fabric is impregnated at a temperature of 30° C with an aqueous dye liquor containing per 1000 ml 40 g of the dyestuff of the formula:

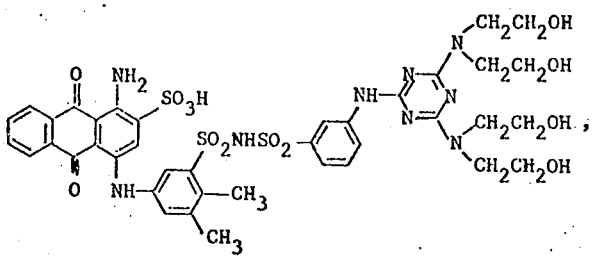

220 g of a 50 percent aqueous solution of N,N'-dimethylolethylene urea and 15 g of zinc chloride; the material is subsequently squeezed out to obtain a liquor content of 65 percent, dried for 3 minutes at 95° C, and then heated at 180° C for 2 minutes.

An intensely blue cotton dyeing is thus obtained having good fastness to light.

If, instead of the 15 g of zinc chloride, 16 g of ammonium sulphate are used, and instead of the 40 g of the dyestuff of the above formula, the identical amounts of the dyestuffs listed in the following Table III, Column II, are applied, the procedure being otherwise as described in the example, then deeply coloured and well finished cotton dyeings are obtained having the shades shown in Column III.

300 g of a 50 percent aqueous solution of N,N'-dimethylolethylene urea, 15 g of zinc chloride and 20 g of starch; the impregnated cotton fabric is then squeezed out to a liquor content of 65 percent, dried for 3 minutes at 95° C, and then heated at 180° C for 2 minutes. The cotton fabric is subsequently rinsed, soaped at the boil for 10 minutes, and again rinsed and dried.

Table III

| I Example No. | II Dyestuff | III Shade on cotton |
|---|---|---|
| 5 | 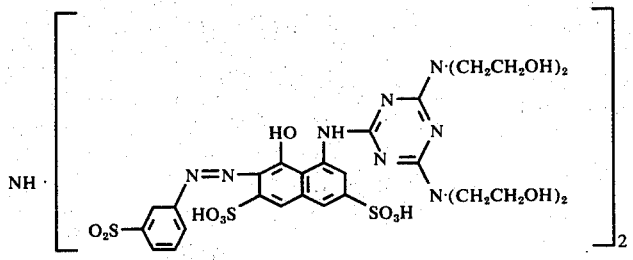 | bluish-red |
| 6 | 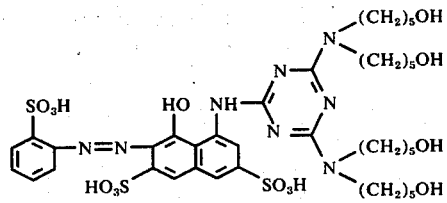 | red |
| 7 | 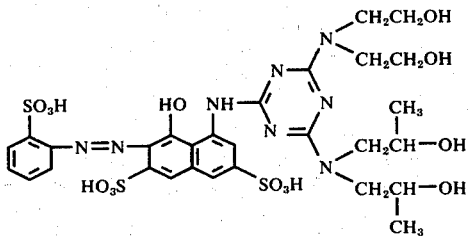 | red |
| 8 | 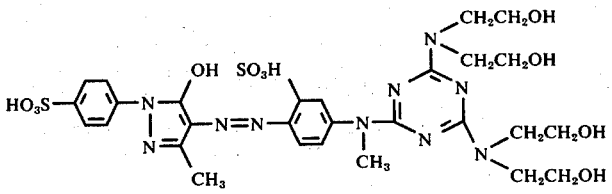 | yellow |

EXAMPLE 9

Cotton fabric is impregnated at a temperature of 30° C with an aqueous dye liquor containing per 1000 ml 50 g of the dyestuff of the formula:

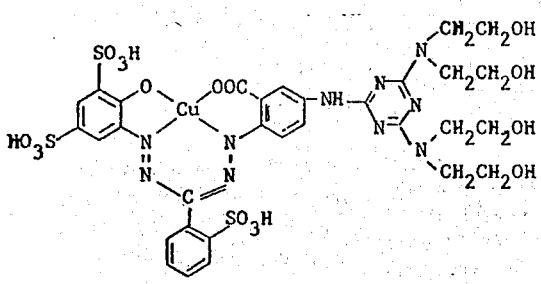

In this way is obtained a deeply coloured blue cotton dyeing having a good fastness to washing and to light, as well as a modified feel.

EXAMPLE 10

Cotton fabric is impregnated at a temperature of 20° to 25° C with an aqueous dye liquor containing per 1000 ml 40 g of the dyestuff of the formula:

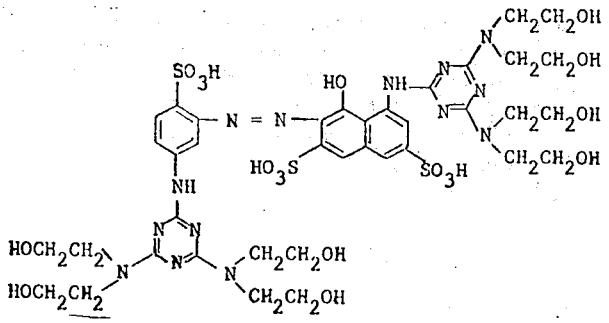

180 g of a 50 percent aqueous solution of N,N'-dimethyloldihydroxyethylene urea, 20 g of zinc nitrate and 25 g of polyvinyl alcohol; the impregnated cotton fabric is then squeezed out to a liquor content of ca. 70 percent relative to the dry weight of the material, dried for 4 minutes at 80° C, and then heated at 150° C for 4 minutes. The cotton fabric is subsequently rinsed and dried.

A deeply coloured red cotton dyeing is obtained having a modified feel.

EXAMPLE 11

If the procedure as described in Example 1 is adhered to, using, however, instead of the constituents stated there, 80 g of the dyestuff of the formula:

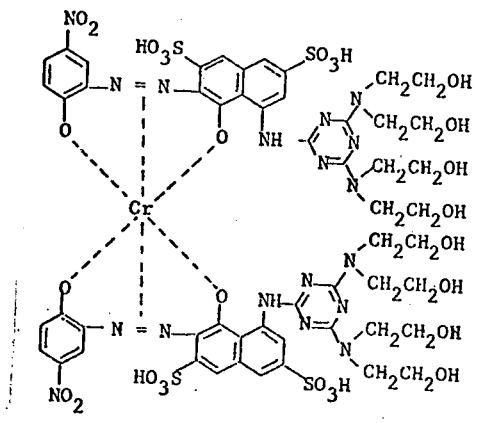

300 g of N,N'-dimethyloldihydroxyethylene urea as a 50 percent aqueous solution, and 12 g of ammonium sulphate, then a deeply coloured black cotton dyeing is obtained having fastness to washing and to light.

EXAMPLE 12

Cotton fabric is impregnated at a temperature of 30° C with an aqueous dye liquor containing per 1000 ml 60 g of the dyestuff of the formula:

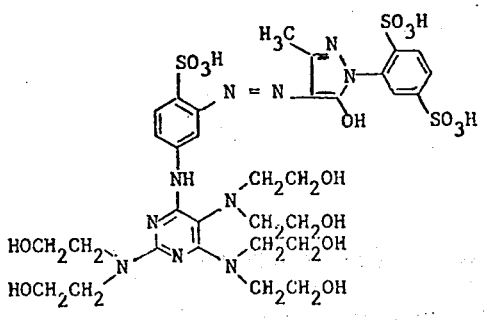

210 g of a 50 percent aqueous solution of tetramethylolacetylene urea and 12 g of ammonium dihydrogen phosphate; the impregnated cotton fabric is then squeezed out to a liquor content of ca. 65 percent relative to the dry weight of the material, dried for 3 minutes at 90° C, and then heated at 170° C for 3 minutes. The material is subsequently rinsed and dried.

In this manner is obtained a deeply coloured yellow cotton dyeing having a very good crease-proof finish and having fastness to light and to washing.

EXAMPLE 13

If, instead of the dyestuff stated in Example 12, 40 g of the dyestuff of the formula:

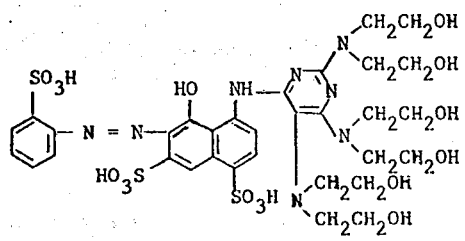

are used, the procedure being otherwise as described in Example 12, then a deeply coloured red cotton dyeing is obtained having a crease-proof finish and fastness to washing.

EXAMPLE 14

A printing paste is prepared having the following composition:

40 g of the dyestuff of the formula:

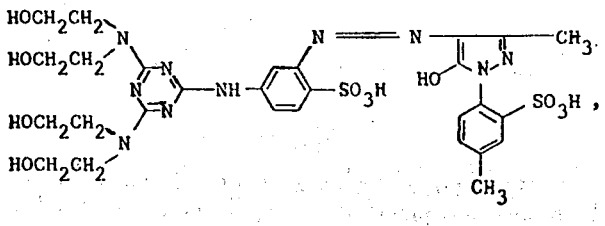

| | |
|---|---|
| 200 | g of melamine/formaldehyde resin, |
| 400 | g of sodium alginate as a 5% sclution, |
| 20 | g of ammonium sulphate, |
| 340 | g of water. |
| 1000 | g |

This printing paste is applied, e.g. by means of stencils, to the cotton fabric, the fabric dried and subsequently heated at 160° C for 5 minutes. The printed cotton fabric is then rinsed, soaped for 10 minutes at the boil, and again rinsed and dried.

On the printed areas is obtained a cotton fabric dyed a very intense yellow and having a crease-proof finish.

EXAMPLE 15

A spun rayon fabric is impregnated at a temperature of 25° to 30° C with an aqueous liquor containing per liter 40 g of the dyestuff of the formula:

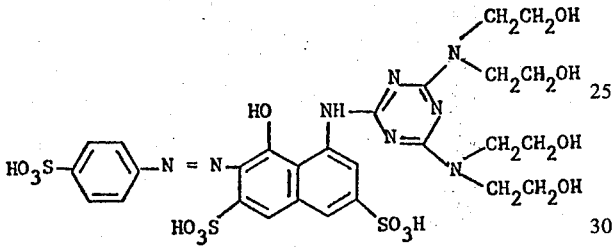

200 g of a 50 percent aqueous solution of N,N'-dimethyloldihydroxyethylene urea, and 15 g of ammonium chloride;

the material is then squeezed out to give approximately 70 percent increase in weight, steamed for 4 minutes at 103° C, and subsequently hardened for 4 minutes at 150° C. The material is afterwards rinsed and dried. In this manner is obtained a deeply coloured, bluish red spun rayon dyeing having fastness to light and to washing; the dyed material also has a good non-creasing finish.

EXAMPLE 16

A cotton fabric is impregnated at a temperature of 20° to 25° C with an aqueous liquor containing per liter 50 g of the dyestuff of the formula:

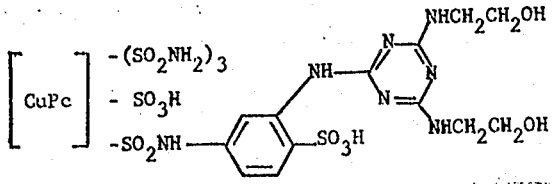

200 g of a 50 percent aqueous solution of N,N'-dimethyloldihydroxyethyleneurea, and 12 g of zinc chloride;

the fabric is then squeezed out to give about 75 percent weight increase, steamed for 5 minutes at 103° C, and subsequently hardened for 2 minutes at 170° C. In this manner is obtained, after rinsing and drying of the material, a turquoise dyeing of the cotton having very good fastness to light and to washing, and also a non-creasing finish.

Likewise suitable is the dyestuff of the following formula:

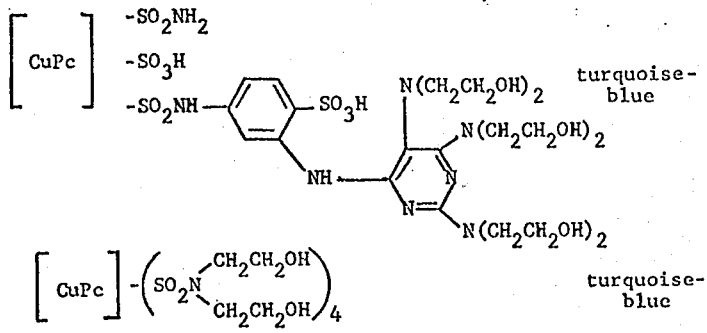

turquoise-blue turquoise-blue

EXAMPLE 17

A cotton fabric is printed with a printing paste of the following composition:

40 g of the dyestuff of the formula

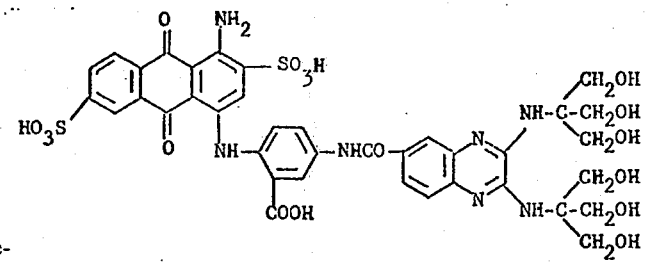

| | |
|---|---|
| 200 g | of melamine formaldehyde resin |
| 400 g | of sodium alginate as a 5% solution |
| 20 g | of ammonium sulphate |
| 340 g | of water |
| 1000 g | |

The printed fabric is steamed for 5 minutes at 100° C and subsequently hardened for 5 minutes at 150° C. In this manner is obtained, after washing and drying of the fabric, a deeply coloured printing blue in colour and having fastness to light and to washing; the fabric is additionally non-creasing.

Instead of the above mentioned dyestuff, the following dyestuff may also be used:

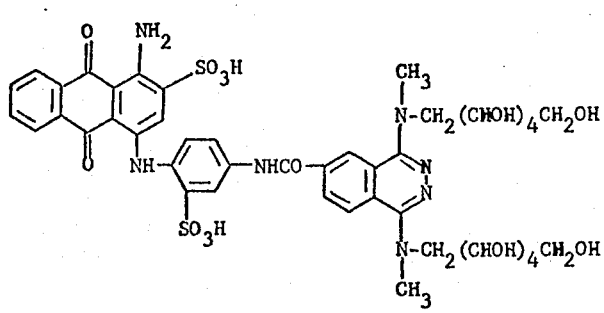

(blue)

EXAMPLE 18

A cotton fabric is padded at a temperature of 25° C with an aqueous liquor of the following composition:

50 g of the dyestuff of the formula:

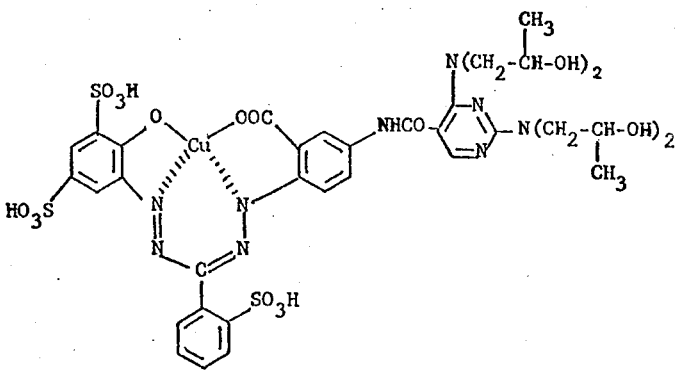

| | |
|---|---|
| 210 g | of a 50% aqueous solution of tetramethylol-acetyleneurea |
| 12 g | of ammonium dihydrogen phosphate |
| 718 g | of water |
| 1000 g | |

The impregnated fabric is squeezed out to give a weight increase of 75 percent; it is then steamed for 3 minutes at 100° C, and hardened for a further 3 minutes at 170° C. A subsequent washing treatment is not necessary. By this means is obtained a deeply coloured blue dyeing; the fabric moreover possesses improved handle properties and has a non-creasing finish.

A dyestuff which is likewise suitable corresponds to the formula:

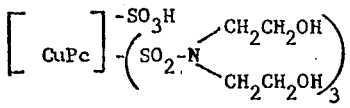

(turquoise blue)

CuPc = copper phthalocyanine

EXAMPLE 19

A spun rayon fabric is impregnated at a temperature of 25° to 30° C with an aqueous liquor containing per 1000 ml 40 g of the dyestuff of the formula:

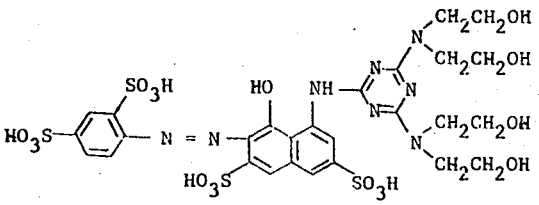

200 g of a 50 percent aqueous solution of N,N'-dimethyloldihydroxyethylene urea and 15 g of ammonium chloride; the material is then squeezed out to give approximately 70 per cent increase in weight, the fabric is then stored at room temperature for 24 hours and subsequently heated for 4 minutes at 150° C. The material is afterwards rinsed and dried. In this manner is obtained a deeply coloured, bluish red spun rayon dyeing having fastness to light and to washing; the dyed material also has a good non-creasing finish.

We claim:

1. A process for the dyeing or printing and simultaneous finishing of a cellulose material, which comprises impregnating the cellulose material with an aqueous liquor containing.

a. at least one dyestuff of the formula

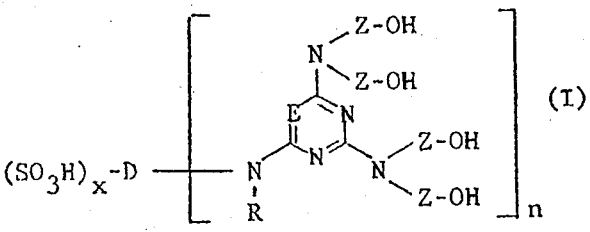

(I)

$$(W)_{m-1} - D' - [A_1 - X_1]_n \quad \text{(IIa)}$$

$$(W)_{m-1} - D' - [A_2 - X_1]_n \quad \text{(IIb)}$$

wherein

D represents the radical of an azo or anthraquinone dyestuff, x represents an integer of from 1 to 4, R represents hydrogen or lower alkyl, E represents

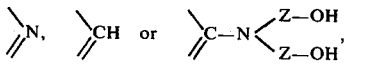

Z each independently represents alkylene having 2 to 5 carbon atoms,

*n* represents the integer 1 or 2,

W represents $SO_3H$ or COOH,

D' represents a chromophorous radical of a formazan, azomethine, azo, anthraquinone, nitro or phthalocyanine dyestuff, $X_1$ represents hydroxyalkyl of 1 to 10 carbon atoms or cyclohexyl having at least one hydroxyl group, $A_1$ represents a heterocyclic-aromatic radical, a substituted amino, carbonamido, sulphonamido or alkyleneaminocarbonyl radical, $-SO_2-$ or $-NH-CO-$, $A_2$ represents $-NX_1-$, $-SO_2NX_1-$, $-CONX_1-$, $-(CH_2)_pNHCOX_1-$ or a group of the formula

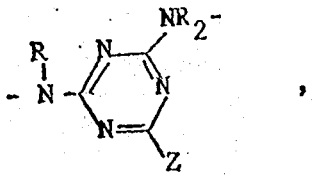

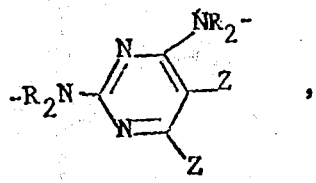

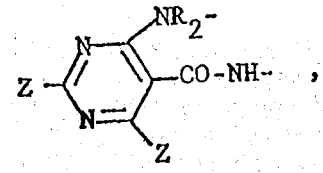

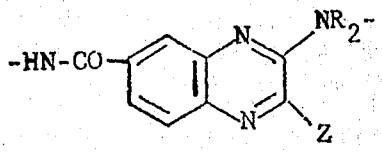

or

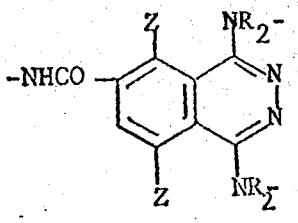

herein $X_1$ has the meaning given above,

*p* represents the integer 1 or 2,

R represents hydrogen or alkyl of 1 to 4 carbon atoms, $R_2$ represents hydrogen, alkyl of 1 to 4 carbon atoms, a hydroxyalkyl, methoxyalkyl or ethoxyalkyl group of 1 to 6 carbon atoms or cycloalkyl having at least one hydroxyl group, and Z represents hydrogen, halogen, alkyl, aryl, alkoxy, aryloxy, alkylmercapto, arylmercapto, an unsubstituted or substituted amino group, hydroxyl or a thiocyanato group, and

*m* and *n'* represent integers of from 1 to 4, b. a synthetic resin-forming intermediate product selected from the group consisting of epoxides, polyisocyanates, condensates of formaldehyde with a phenol, a cresol or acrolein, and mixtures containing methylol derivatives of monomeric or polymeric compounds which contain amino or monosubstituted amino groups or lower alkyl ethers of such methylol derivatives, or an aminoplast which is soluble or at least dispersible in water, and c. an acid catalyst, storing at room temperature, drying or steaming the impregnated material, and heat-treating the resultant material at an elevated temperature.

2. A cellulose material dyed or printed and finished according to the process of claim 1.

3. The process according to claim 1, wherein the aqueous liquor further contains at least one member selected from the group consisting of thickeners and textile finishing agents.

4. The process according to claim 1, wherein the heat-treated material is washed.

5. The process according to claim 1, wherein component *a* is at least one dyestuff of formula I, component *b* is the synthetic resin-forming intermediate product and the impregnated material is dried and heat-treated.

6. The process according to claim 5, wherein the cellulose material is impregnated with an aqueous liquor simultaneously containing the dyestuff, the synthetic resin-forming intermediate and the acid catalyst.

7. The process according to claim 5, wherein the dyestuff is used in an amount of 10 to 100 g/l.

8. The process according to claim 5 wherein the synthetic resin-forming intermediate is used in an amount of 50 to 300 g/l.

9. The process according to claim 5, wherein the impregnated material is squeezed out and dried at 50° to 100° C for 1 to 15 minutes.

10. The process according to claim 9, wherein the dried material is heated at 100° to 220° C for 30 seconds to 30 minutes.

11. The process according to claim 9, wherein the stored or steamed material is dried prior to the heat-treatment.

12. The process according to claim 1, wherein the impregnated material is stored at room temperature or steamed.

13. The process according to claim 12, wherein the dyestuff has the formula IIa.

14. The process according to claim 12, wherein the dyestuff has the formula IIb.

15. The process according to claim 12, wherein the dyestuffs are metal complexes of mono- and disazo dyestuffs.

16. The process according to claim 12, wherein the dyestuffs are copper phthalocyanine dyestuffs.

17. The process according to claim 12, wherein the dyestuffs are 1,4-diamino-anthraquinones.

18. The process according to claim 12, wherein the aminoplasts used are addition products of formaldehyde with aminotriazines, oxydiaminotriazines, dioxyaminotriazines, triazones, guanamines, ureas or thioureas.

19. The process according to claim 18, wherein the aminoplasts used are methylolamines, methylolureas, methylol compounds of ethyleneurea and of dicyanodiamide, or methylolmelamines, methylolureas or methylolated ethyleneureas partially or completely etherified with $C_1$ to $C_5$-alkanols.

20. The process according to claim 18, wherein the aminoplasts used are methylolated derivatives of propylene-, guanyl- or acetylenediurea partially or completely etherified with $C_1$ to $C_5$-alkanols, or 4,5-dihydroxyimidazolidinone-2.

21. The process according to claim 12, wherein the catalyst consists of a salt of a weak base and mineral acid.

22. The process according to claim 21, wherein the catalyst is ammonium chloride.

23. The process according to claim 21, wherein the catalyst is an ammonium or amine salt.

24. The process according to claim 12, wherein the liquor contains 3 to 30 per cent by weight of aminoplast.

25. The process accordng to claim 24, wherein the liquor contains 5 to 20 per cent by weight of aminoplast.

26. The process according to claim 12, wherein the liquor contains 0.1 to 5 per cent by weight of the catalyst.

27. The process according to claim 26, wherein the liquor contains 0.5 to 2 per cent by weight of the catalyst.

28. The process according to claim 12, wherein the impregnated material is steamed for 3 to 30 minutes, or stored at room temperature for 3 to 48 hours.

29. The process according to claim 12, wherein the heat-treatment is performed at temperatures of 130° to 210° C for 30 seconds to 30 minutes.

30. The process according to claim 29, wherein the heat-treatment is performed at a temperature of 140° to 180° C.

31. A process for dyeing and simultaneous finishing of a cellulose material which comprises impregnating the cellulose material with an aqueous liquor containing a) at least one dyestuff of the formula $$(W)_{m-1} - D' - [A_2 - X_1]_n$$

wherein

W represents $SO_3OH$ or COOH,

D' represents a chromophorous radical of a formazan, azomethine, azo, anthraquinone, nitro or phthalocyanine dyestuff, $A_2$ represents a group of the formula

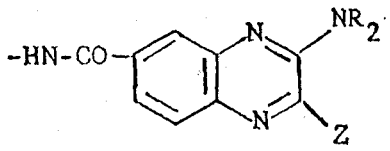

or

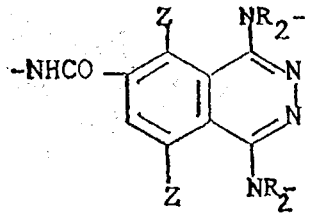

wherein $R_2$ represents a hydroxyalkyl group of 4 carbon atoms having 3 hydroxy groups or a hydroxyalkyl group of 6 carbon atoms having 5 hydroxy groups and Z represents hydrogen, halogen, alkyl, aryl, alkoxy, aryloxy, alkylmercapto, arylmercapto, unsubstituted amino, monoalkylamino of 1–4 carbon atoms, dialkylamino of 1–4 carbon atoms in each alkyl group, hydroxyalkylamino, phenylamino, sulphophenylamino, disulphophenylamino, naphthylamino, sulphonaphthylamino, disulphonaphthylamino, benzylamino, cyclohexylamino, hydroxyl or a thiocyanato group, b. an aminoplast which is soluble or at least dispersible in water, and c. an acid catalyst, storing at room temperature, steaming the impregnated material, and heat-treating the resultant material at an elevated temperature.

* * * * *